United States Patent [19]

Kimmett

[11] 3,993,998

[45] Nov. 23, 1976

[54] DIRECTIONAL LOOP ANTENNA WITH PLURAL DIELECTRIC COVERINGS

[76] Inventor: James P. Kimmett, 703 Pierce St., Delphos, Ohio 45833

[22] Filed: June 6, 1975

[21] Appl. No.: 584,362

[52] U.S. Cl. ..... 343/744; 343/802; 343/804

[51] Int. Cl.[2] ..... H01Q 1/44; H01Q 7/00

[58] Field of Search ..... 343/743, 744, 742, 741, 343/803, 804, 908

[56] References Cited

UNITED STATES PATENTS

| | | | |
|---|---|---|---|
| 2,472,106 | 6/1949 | Hansen | 343/804 |
| 3,582,951 | 6/1971 | Altmayer | 343/743 |

*Primary Examiner*—Alfred E. Smith
*Assistant Examiner*—David K. Moore
*Attorney, Agent, or Firm*—Vincent L. Barker, Jr.

[57] ABSTRACT

A directional loop antenna, particularly for television signals, comprising a conductive member shaped into a folded dipole configuration is disclosed. Covering the conductive member is a plastic material which may comprise two coaxial coatings of different dielectric constants. The folded dipole legs are formed into a generally circular configuration with the folded ends brought together and overlapped to form a pair of loops. The two loops thus formed lie in planes which intersect each other at a point beyond the forward side of the antenna. At the opposite side of the loops, the two ends of the conductive member emerge to form terminals for connection to a transmission line. At this side of the antenna the loops are spaced farther apart than at the side where the folded dipole ends overlap. This construction results in a highly directional antenna capable of wide frequency band reception with a good match to a 300 ohm transmission line.

6 Claims, 4 Drawing Figures

DIRECTIONAL LOOP ANTENNA WITH PLURAL DIELECTRIC COVERINGS

BACKGROUND OF THE INVENTION

The invention relates to antennas and more particularly to a directional folded dipole antenna particularly adapted for television reception.

Numerous antenna designs have been suggested and are available commercially, including a large number of folded dipole antennas. See, for example, U.S. Pat. Nos. 2,324,462, 2,447,879, 2,551,654 and 3,448,454. See also U.S. Pat. Nos. 3,573,830 and 3,573,832 showing various loop antennas, the former of which is stated to be directional.

While most of the designs of the above patents are suitable for their stated purposes, they generally do not exhibit the simplicity and efficiency of the present antenna construction as described below. It is well known that nondirectional or "omnidirectional" antennas are not as desirable in certain instances as a unidirectional antenna. In addition, many of the antennas presently available are capable of transmission or reception only through a relatively narrow bandwidth, and most exhibit substantial interference when touched or when placed in proximity to metals. Also, several of the prior art antennas are quite complex in construction and many are not as compact and portable as is the present antenna described below.

SUMMARY OF THE INVENTION

A directional loop antenna according to the invention consists of a conductive wire-like member shaped into a folded dipole configuration with the folded ends of the dipole formed into a generally circular loop and overlapping, but not contacting one another. This overlap configuration not only creates a capacitive coupling between the dipole ends, but also further aids in producing good reception as discussed below. The antenna is highly directional, with the overlapped portion as the forward side of the antenna. The conductive member is preferably covered with a covering of dielectric material, which may comprise two concentric dielectrically dissimilar coatings, to aid in directing the oncoming electrical field into close proximity with the conductive member, thereby reducing reradiation from the antenna. In addition, a structural member encasing the overlapped folded dipole ends is preferably oval shaped and of a dielectric material, and oriented in longitudinal alignment with the path of the loops defined by the conductive member. The shape and orientation of the structural member help minimize losses due to reradiation.

The two loops formed by the folded dipole conductive member are preferably of different perimeter lengths, with the loops closer together at the forward side of the antenna than at the opposite side. The loops also lie generally in separate planes which intersect somewhere in front of the forward side of the antenna, so that the separation between the loops at the opposite side is even greater.

One of the loops of the conductive member is broken at the rearward side of the antenna to form terminals for connection to a transmission line. The two loops are also encased in this area, to add structural stability to the antenna and to provide a means for mounting the antenna on a table stand, on top of a motor vehicle, etc.

The construction of the present antenna provides good bandwidth and gain characteristics, so that the antenna is capable of receiving the common television channels from remote locations, from 54 megahertz into the UHF region, while maintaining a good match to a standard 300 ohm transmission line.

The antenna of the present invention is also advantageous in that it is small in size and weight in comparison to many other available antennas. Though the antenna is extremely rugged in service, its manufacture and assembly are relatively simple and not costly. Also, the antenna works extraordinarily well in close proximity to materials such as sheet metal which would normally interfere with most antennas, and is effected very little even by physically handling during orientation.

DESCRIPTION OF THE PREFERRED EMBODIMENT

Figure 1:
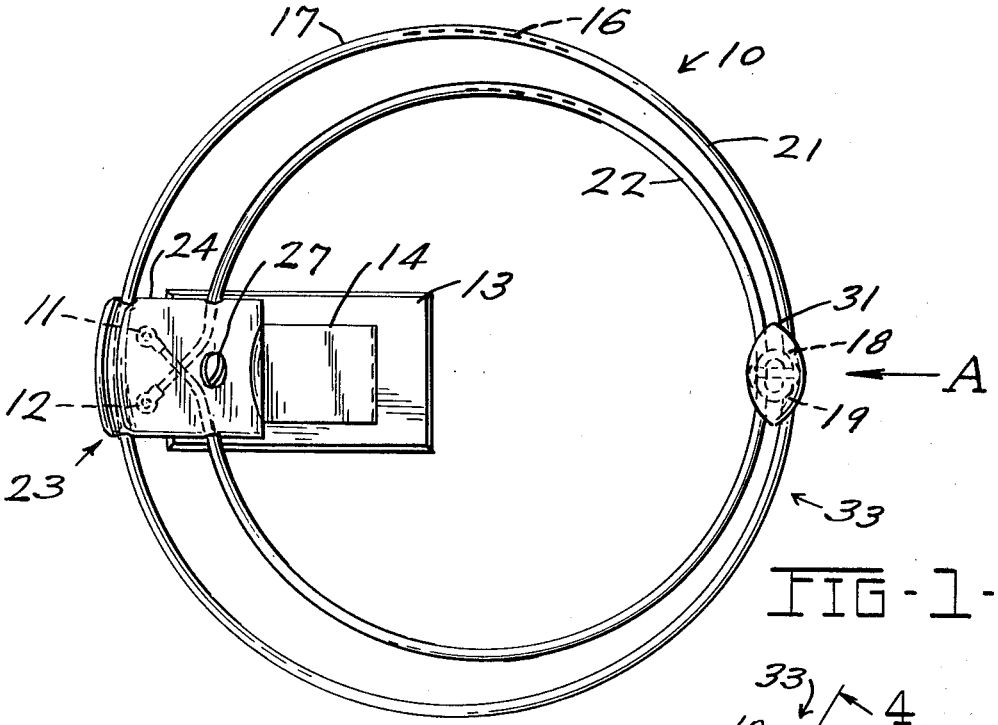
FIG. 1 is a plan view of a directional loop antenna according to the invention.
Figure 2:
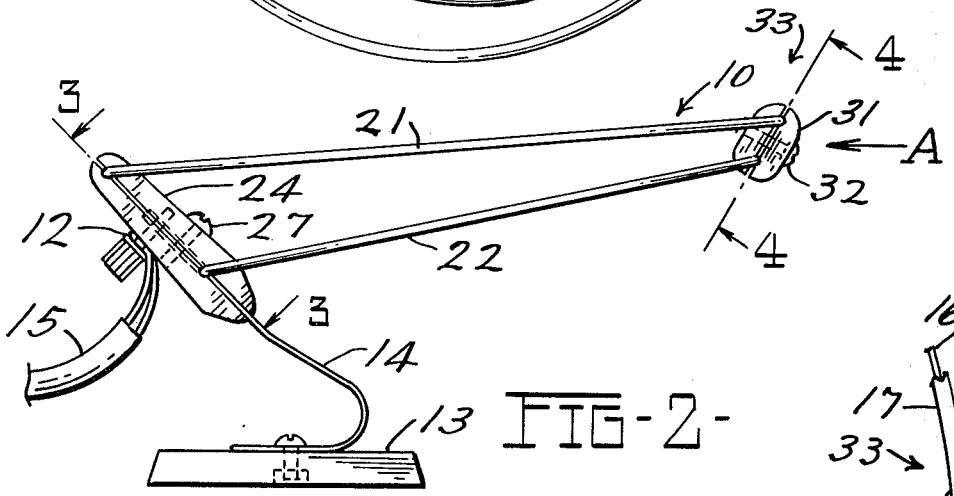
FIG. 2 is an elevational view of the antenna.

FIG. 1 shows a directional loop antenna 10 according to the invention having a set of terminals 11 and 12 for connection to a transmission line 15 (FIG. 2), the antenna being supported on a base 13, a portion of a vehicle top, a mast, etc. As shown in FIG. 2, a support bracket 14 from the antenna 10 connects to the base 13 and is shaped in such a way to balance the antenna 10 against tipping.

Figure 3:
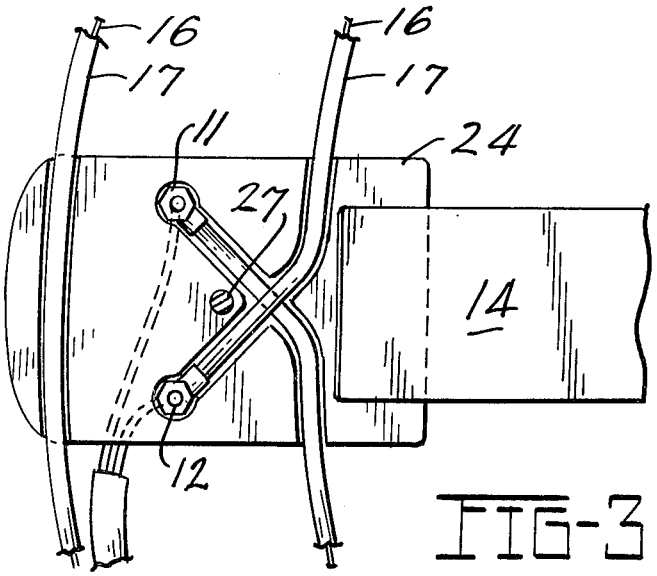
FIG. 3 is a sectional view taken along the line 3—3 of FIG. 2.
Figure 4:
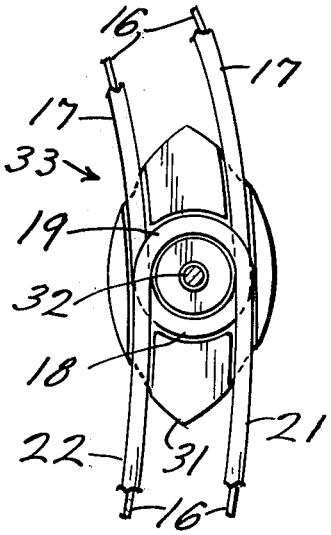
FIG. 4 is a sectional view taken along the line 4—4 of FIG. 2.

As indicated in FIGS. 3 and 4, the receiving portion of the antenna comprises a conductive wire-like member 16 which is covered with a coating 17. The coating 17 on the conductive member 16 adds substantial thickness, and it may be made up of two successive coaxial coatings. The coatings may be plastic or other dielectric materials which have different dielectric constants. The materials may be, for example, polyvinylchloride and polyethylene. It is surmised that the dissimilar coatings may aid in directing energy over the conductive member and help minimize reradiation. The conductive member 16 is continuous from one terminal 11 to the other terminal 12.

As shown in FIG. 1, the continuous conductive member 16 with its coating 17 is formed into a folded dipole configuration. The dipole legs are formed into a circular configuration with folded ends 18 and 19 overlapping in a cross coupling, thereby defining a pair of planar circular loops 21 and 22, the latter of which is of smaller diameter and, of course, smaller length. In the preferred embodiment, the preferred diametric dimensions (to the outside of the coating) of the two loops 21 and 22 are 19.1 inches and 15.28 inches, respectively. At the terminal side 23 of the double loop antenna 10, the coated conductive member 16 forming the loops 21 and 22 is embedded in a plastic encasement 24 which supports the terminals 11 and 12 and receives the support bracket 14. Although the terminals are shown coming from the smaller loop 22, it should be understood that either of the loops can be broken to form terminals at the terminal side 23. As indicated in FIGS. 2 and 3, the encasement 24 may comprise two halves which are tightened together over the coated conductive wire 16 by a fastener 27. The terminal ends of the coated conductive wire 16 are crossed over one another in the encasement 24 as shown in FIGS. 1 and 3 for structural support of the smaller loop 22 and for convenience of arrangement of the terminals 11 and 12. The crossing is at a right angle so that the two ends exert minimum influence on one another at this point.

As seen in FIGS. 1, 3 and 4, a structural member 31 of a dielectric material such as a plastic encapsulates the overlapped portion of the two folded dipole ends 18 and 19 to maintain the proper spacing relationship between the overlapped ends 18 and 19 and to give the antenna 10 rigidity. The dielectric material may be similar to one of the conductive member coatings described above. The structural member 31 is oval shaped and longitudinally oriented with respect to the path of the loops 21 and 22, as seen in FIGS. 1 and 4. Like the encasement 24 at the terminal end 23 of the antenna 10, the member 31 may comprise two halves which are tightened together by a fastener 32 over the folded dipole ends 18 and 19. Preferably the member 31 is somewhat obliquely angled with respect to horizontal as seen in FIG. 2. The shape, orientation and makeup of the structural member 31 are thought to minimize losses caused by the necessary placement of a structural connector at this location on the antenna 10.

As also shown in FIG. 4, the overlapping dipole ends 18 and 19 preferably are so positioned to define an approximate circle within the encapsulating pod 31. The one dipole end 18 lies beneath the other dipole end 19, and the coatings 17 of the ends may be in contact with one another. Thus, the portion of the conductive member 16 in the one folded dipole end 18 is spaced from that in the other dipole end 19. During design of the antenna 10, it was found that moving the ends 18 and 19 together to form a greater overlap decreased both VHF and UHF reception. Similarly, if the ends 18 and 19 were moved in the opposite direction, reception dropped off sharply once the overlap was eliminated.

The construction described above results in a very efficient, highly directional receiving antenna with good bandwidth characteristics. The antenna 10 receives signals such as the signal A (FIGS. 1 and 2) from a direction straight off the member 31 at what may be called the "front" end 33 of the antenna 10. The reception characteristics of the antenna are attributable to a combination of design features. The coating 17 over the conductive member 16 is believed to refract the oncoming electrical field and cause it to follow to some extent the conductive member 16 more closely than would otherwise be the case. This helps prevent the reradiation of the field energy away from the antenna, a problem normally encountered with receiving antennas. The use of successive coatings to make up the coating 17 may aid in this effect. The coating 17 also helps prevent interference by precipitation when the antenna is mounted outside.

The antenna 10 is preferably oriented approximately as shown in FIG. 2, with the upper loop 21 approximately horizontal but inclined slightly toward the origin of the transmission. Also, the structural members 24 and 31 are preferably disposed obliquely as shown, but may be inclined otherwise without appreciable change of reception characteristics.

The front end 33 of the antenna 10, where the folded dipole ends 18 and 19 overlap within the pod 31, is the high voltage point of the antenna 10. The overlapping of the two folded ends places the two loops of the conductive member 16 in spaced relationship from one another, as discussed above, due to the thickness of the coating 17. A capacity thus results between the two folded dipole ends 18 and 19, increasing the effective electrical length of the folded dipole antenna 10 in a well known manner. However, the overlapped dipole ends, forming an approximately circular pattern as seen in FIG. 4, also adds appreciably to the reception characteristics of the antenna. The reason for this effect is not completely understood but is clearly demonstrable.

As the figures illustrate, the two loops 21 and 22 of the antenna 10 are closer together at the front end 33 than at the terminal end 23. Also, as shown in FIG. 2, the circular loops 21 and 22 lie approximately in separate but intersecting planes. These theoretical planes intersect somewhere in front of the pod 31. This construction is believed also to add to the efficiency and directional character of the antenna 10. The variation in proximity and difference in lengths of the loops 21 and 22 are believed to contribute to the good bandwidth characteristics of the antenna.

When the preferred embodiment of the antenna was tested for use with television, it was able to clearly receive VHF stations over 90 miles distant when oriented in the proper direction. During testing a large conductive metal cookpot was placed inside the two loops 21 and 22 defined by the conductive member 16, and the coated member 16 was repeatedly touched. Reception was unaffected.

The above described preferred embodiment provides a highly efficient and directional antenna which is very compact and may be utilized for indoor or mast-mounted outdoor television reception, on the top of a boat or a vehicle such as a camper, or in other suitable types of service. The antenna exhibits good gain and bandwidth characteristics, receiving the common television channels as well as UHF and radio FM, and is virtually unaffected by close proximity to metal objects and surfaces. By its construction it is rugged and weather-resistant, as well as simply manufactured and assembled. Various other embodiments and alterations to this preferred embodiment will become apparent to those skilled in the art and may be made without departing from the spirit and scope of the following claims.

I claim:

1. A directional antenna, comprising: a conductive member having a pair of adjacent ends at a first location for connection to a transmission line, said conductive member defining a folded dipole configuration with the legs of the dipole formed into a generally circular loop with the two folded ends of the legs adjacent, overlapping and spaced from one another at a second location, the two folded ends together forming a cross coupling, said folded dipole thus defining a pair of generally circular loops, each of which loops passes through both said first location and said second location with the loops being spaced farther apart at the first location than at the second location such that said loops lie in planes which intersect each other at a point beyond the overlapped folded ends.

2. The antenna of claim 1 which further includes a coating of dielectric material covering said conductive member.

3. The antenna of claim 1 wherein said loops are of different perimeter lengths.

4. The antenna of claim 3 wherein said loops lie substantially in separate but intersecting planes.

5. A directional folded dipole antenna, comprising a conductive member having adjacent ends at a first location for connection to a transmission line, said conductive member defining a folded dipole configuration with the legs of the dipole formed into a generally circular configuration with the folded ends of the legs adjacent and overlapping but not contacting one another at a second location diametrically opposed to said first location, the circular folded dipole defining a pair of loops, each loop passing through both said first and second locations, and an oval shaped structural member of dielectric material encapsulating the overlapped folded ends of the dipole at said second location, said oval shaped structural member being generally longitudinally aligned with the paths of said loops at said location.

6. A directional folded dipole antenna, comprising a conductive member covered with two coaxially placed coatings of a dissimilar dielectric material, said conductive member having adjacent ends at a first location for connection to a transmission line, said conductive member defining a folded dipole configuration with the legs of the dipole formed into a generally circular configuration with the folded ends of the legs adjacent and overlapping but not contacting one another at a second location diametrically opposed to said first location, the circular folded dipole defining a pair of loops, each loop passing through both said first and second locations.

* * * * *